US010381721B2

(12) United States Patent
Wang et al.

(10) Patent No.: US 10,381,721 B2
(45) Date of Patent: Aug. 13, 2019

(54) HANDHELD DEVICE

(71) Applicant: Huawei Technologies Co., Ltd., Shenzhen, Guangdong (CN)

(72) Inventors: Hanyang Wang, Reading (GB); Liang Xue, Shanghai (CN); Lei Wang, Shanghai (CN); Jiaqing You, Shanghai (CN); Meng Hou, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 54 days.

(21) Appl. No.: 15/541,467

(22) PCT Filed: Jan. 4, 2015

(86) PCT No.: PCT/CN2015/070062
§ 371 (c)(1),
(2) Date: Jul. 3, 2017

(87) PCT Pub. No.: WO2016/106779
PCT Pub. Date: Jul. 7, 2016

(65) Prior Publication Data

US 2017/0373388 A1 Dec. 28, 2017

(51) Int. Cl.
*H01Q 1/24* (2006.01)
*H01Q 5/30* (2015.01)
(Continued)

(52) U.S. Cl.
CPC ..... *H01Q 1/50* (2013.01); *H01Q 1/242* (2013.01); *H01Q 1/243* (2013.01); *H01Q 1/42* (2013.01);
(Continued)

(58) Field of Classification Search
CPC ..... H01Q 1/24; H01Q 1/241; H01Q 1/242; H01Q 1/243; H01Q 1/42; H01Q 1/44;
(Continued)

(56) References Cited

U.S. PATENT DOCUMENTS 6,339,400 B1 * 1/2002 Flint ..... H01Q 1/22 343/702
8,515,496 B2 * 8/2013 Cheng ..... H01Q 1/243 455/562.1
(Continued)

FOREIGN PATENT DOCUMENTS

CN 102394372 A 3/2012
CN 102694904 A 9/2012
(Continued)

*Primary Examiner* — Daniel Munoz
*Assistant Examiner* — Patrick R Holecek

(57) ABSTRACT

A handheld device includes a metal frame, two switches, and an antenna feedpoint, where two slits are disposed at the metal frame; the slits divide the metal frame into a left frame, a middle frame, and a right frame; two sides of each slit are bridged by one switch, where one of the switches is in a connected state, the other of the switches is in a disconnected state, and the two switches perform state switching when a user's finger connects a slit corresponding to the switch in a disconnected state; and the antenna feedpoint is electrically connected to the middle frame, and the left frame and the right frame are grounded, to form an antenna.

15 Claims, 6 Drawing Sheets

(51) Int. Cl.

| | |
|---|---|
| ***H01Q 21/28*** | (2006.01) |
| ***H01Q 1/50*** | (2006.01) |
| ***H01Q 1/44*** | (2006.01) |
| ***H01Q 5/328*** | (2015.01) |
| ***H01Q 1/42*** | (2006.01) |
| ***H01Q 9/42*** | (2006.01) |
| ***H01Q 5/321*** | (2015.01) |

(52) U.S. Cl.
CPC ..... *H01Q 1/44* (2013.01); *H01Q 5/321* (2015.01); *H01Q 5/328* (2015.01); *H01Q 9/42* (2013.01); *H01Q 21/28* (2013.01)

(58) Field of Classification Search
CPC ..... H01Q 1/50; H01Q 5/307; H01Q 5/314; H01Q 5/321; H01Q 5/328; H01Q 5/357; H01Q 5/364; H01Q 5/371; H01Q 9/42; H01Q 21/28
See application file for complete search history.

(56) References Cited

U.S. PATENT DOCUMENTS

| | | | | |
|---|---|---|---|---|
| 9,024,823 | B2 * | 5/2015 | Bevelacqua ..... | H01Q 9/42 343/702 |
| 9,166,279 | B2 * | 10/2015 | Jin ..... | H01Q 1/243 |
| 9,728,854 | B2 * | 8/2017 | Kim ..... | H01Q 1/243 |
| 2012/0009983 | A1 | 1/2012 | Mow et al. | |
| 2014/0162734 | A1 | 6/2014 | Shewan et al. | |
| 2016/0301134 | A1 | 10/2016 | Li et al. | |

FOREIGN PATENT DOCUMENTS

| | | | |
|---|---|---|---|
| CN | 103296385 | A | 9/2013 |
| CN | 103346397 | A | 10/2013 |
| CN | 103390793 | A | 11/2013 |
| CN | 203466292 | U | 3/2014 |
| CN | 103905077 | A | 7/2014 |
| CN | 104051842 | A | 9/2014 |
| CN | 104115331 | A | 10/2014 |
| CN | 104143681 | A | 11/2014 |
| EP | 2405534 | A1 | 1/2012 |
| WO | 2012166268 | A1 | 12/2012 |

* cited by examiner

HANDHELD DEVICE

CROSS-REFERENCE TO RELATED APPLICATION AND CLAIM OF PRIORITY

This application is a national stage of International Application No. PCT/CN2015/070062, filed on Jan. 4, 2015, which is hereby incorporated by reference in its entirety.

TECHNICAL FIELD

The present invention relates to the field of wireless technologies, and in particular, to a handheld device.

BACKGROUND

With increasing development of technologies and techniques for handheld communications devices (a mobile phone, a PAD, and the like), consumers have increasingly high requirements on mobile phone appearance and communication quality. Mobile phone makers always devote themselves to a mobile phone architecture design that is based on a metal appearance design, for example, from an original metal frame to today's all-metal back cover.

In the prior art, to improve antenna performance, an antenna is formed mainly by disposing a slit on a metal frame or on a frame of an all-metal back cover. However, the slit is generally located at the bottom or on either side of the frame, and a user's finger easily touches the slit. When the user's finger touches the slit, severe frequency deviation may occur on the antenna, making signal quality sharply deteriorate by 20-30 dB, which is referred to as a so-called "death grip" and severely affects communication quality of a handheld communications device.

SUMMARY

The present invention provides a handheld device, to resolve a problem in the prior art that communication quality of a handheld communications device deteriorates because of human body contact.

A first aspect of the present invention provides a handheld device, including:

a metal frame, two switches, and an antenna feedpoint, where two slits are disposed at a bottom of the metal frame, or a slit is disposed on either side of the metal frame, where the slits divide the metal frame into a left frame, a middle frame, and a right frame;

two sides of each slit are bridged by one of the switches, where one of the switches is in a connected state, the other of the switches is in a disconnected state, and the two switches are configured to perform state switching when a user's finger connects a slit corresponding to the switch in a disconnected state; and the antenna feedpoint is electrically connected to the middle frame, and the left frame and the right frame are grounded, to form an antenna.

Based on the first aspect, in a first implementation manner of the first aspect, the switch is a single-pole, single-throw switch.

Based on the first implementation manner of the first aspect, in a second implementation manner of the first aspect, an output terminal of the switch is serially connected to an inductor or a capacitor, to finely adjust a resonance frequency of the antenna.

Based on the first aspect, in a third implementation manner of the first aspect, the switch is a single-pole, double-throw switch.

Based on the third implementation manner of the first aspect, in a fourth implementation manner of the first aspect, each output terminal of the switch is serially connected to the metal frame by using an inductor or a capacitor, to perform a frequency band handover when the two switches perform state switching.

Based on the first aspect, in a fifth implementation manner of the first aspect, the switch is a double-pole, four-throw switch.

Based on the first aspect, or the first implementation manner of the first aspect, or the third implementation manner of the first aspect, or the fifth implementation manner of the first aspect, in a sixth implementation manner of the first aspect, distances from the antenna feedpoint to the two switches are equal.

Based on any one of the first implementation manner to the fifth implementation manner of the first aspect, in a seventh implementation manner of the first aspect, distances from the antenna feedpoint to the two switches are not equal.

Based on any one of the first aspect or the first implementation manner to the fifth implementation manner of the first aspect, in an eighth implementation manner of the first aspect, that the antenna feedpoint is electrically connected to the middle frame includes: the antenna feedpoint is directly connected to the middle frame by using an antenna trace, or the antenna feedpoint is connected to the middle frame in a coupling manner by using an antenna trace.

Based on the first aspect, in a ninth implementation manner of the first aspect, there is one or two antenna feedpoints, and the two antenna feedpoints are switched by using a switch.

Based on the first aspect, in a tenth implementation manner of the first aspect, a back cover of the handheld device corresponding to the metal frame is a metal back cover.

Based on the tenth implementation manner of the first aspect, in an eleventh implementation manner of the first aspect, the metal back cover and the metal frame are disposed in an integrated manner.

In the present invention, a handheld device is provided, including: a metal frame, two switches, and an antenna feedpoint, where two slits are disposed at a bottom of the metal frame, or a slit is disposed on either side of the metal frame; the slits divide the metal frame into a left frame, a middle frame, and a right frame; two sides of each slit are bridged by one switch, where one of the switches is in a connected state, the other of the switches is in a disconnected state, and the two switches perform state switching when a user's finger connects a slit corresponding to the switch in a disconnected state; and the antenna feedpoint is electrically connected to the middle frame, and the left frame and the right frame are grounded, to form an antenna. When the user's finger connects the slit corresponding to the switch in a disconnected state, the two switches perform state switching to avoid a "death grip", so that the built-in antenna has one slit in a disconnected state in real time, thereby improving communication quality of the handheld communications device.

DETAILED DESCRIPTION

To make the objectives, technical solutions, and advantages of the embodiments of the present invention clearer, the following clearly and completely describes the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

A handheld device mentioned in this application may be a wireless terminal. The wireless terminal may refer to a device that provides a user with voice and/or data connectivity, a handheld device with a radio connection function, or another processing device connected to a radio modem. The wireless terminal may communicate with one or more core networks through a radio access network (such as RAN, Radio Access Network). The wireless terminal may be a mobile terminal, such as a mobile phone (also referred to as a "cellular" phone) and a computer with a mobile terminal, for example, may be a portable, pocket-sized, handheld, computer built-in, or in-vehicle mobile apparatus, which exchanges voice and/or data with the radio access network. For example, it may be a device such as a personal communication service (PCS, Personal Communication Service) phone, a cordless telephone set, a Session Initiation Protocol (SIP) phone, a wireless local loop (WLL, Wireless Local Loop) station, or a personal digital assistant (PDA, Personal Digital Assistant). The wireless terminal may also be called a system, a subscriber unit (Subscriber Unit), a subscriber station (Subscriber Station), a mobile station (Mobile Station), a mobile terminal (Mobile), a remote station (Remote Station), an access point (Access Point), a remote terminal (Remote Terminal), an access terminal (Access Terminal), a user terminal (User Terminal), a user agent (User Agent), a user device (User Device), or user equipment (User Equipment).

In addition, the term "and/or" in this specification describes only an association relationship for describing associated objects and represents that three relationships may exist. For example, A and/or B may represent the following three cases: Only A exists, both A and B exist, and only B exists. In addition, the character "/" in this specification generally indicates an "or" relationship between the associated objects.

Figure 1:
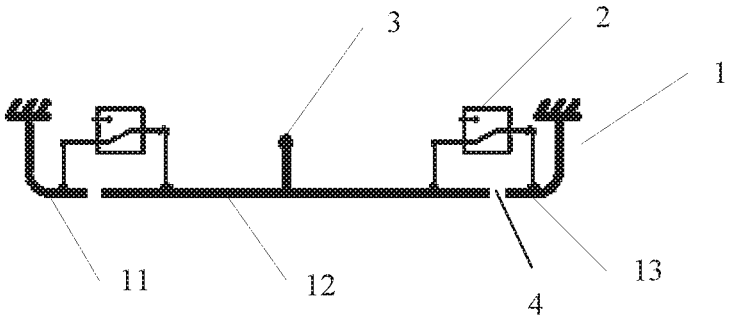
FIG. 1 is a schematic structural diagram of a handheld device according to an embodiment of the present invention.

FIG. 1 is a schematic structural diagram of an embodiment of a handheld device provided in the present invention. As shown in FIG. 1, the handheld device includes: a metal frame 1, two switches 2, and an antenna feedpoint 3.

Two slits 4 are disposed at a bottom of the metal frame 1, or a slit 4 is disposed on either side of the metal frame 1. The slits 4 divide the metal frame 1 into a left frame 11, a middle frame 12, and a right frame 13.

Two sides of each slit 4 are bridged by one switch 2. One switch 2 is in a connected state, the other switch 2 is in a disconnected state, and the two switches 2 are configured to perform state switching when a user's finger connects a slit 4 corresponding to the switch 4 in a disconnected state.

The antenna feedpoint 3 is electrically connected to the middle frame 12, and the left frame 11 and the right frame 13 are grounded, to form an antenna.

Figure 2:
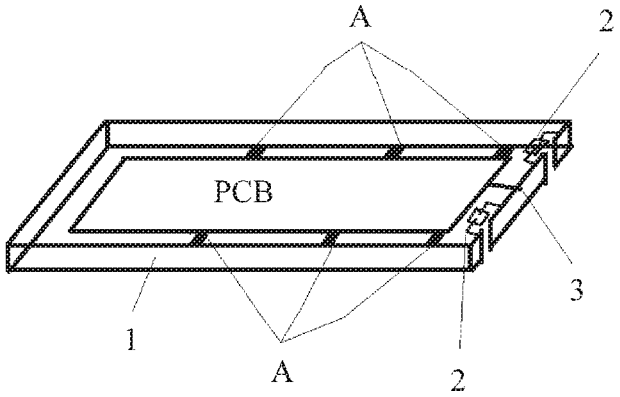
FIG. 2 is a side view of a handheld device according to an embodiment of the present invention.

The metal frame 1 is specifically a metal frame 1 of the handheld device. The metal frame 1 and a back cover of the handheld device may be integrated into a whole or made as independent detachable parts. When the metal frame 1 and the back cover are integrated into a whole, the back cover may be a metal back cover. When the metal frame 1 and the back cover are made as independent detachable parts, the back cover may be a metal back cover or a non-metal back cover. When the back cover is a metal back cover, a connection point of the left frame 11 and the metal back cover and a connection point of the right frame 13 and the metal back cover may be used as ground points of the antenna. When the back cover is a non-metal back cover, a connection point of the left frame 11 and a PCB mainboard of the handheld device and a connection point of the right frame 13 and the PCB mainboard of the handheld device may be used as ground points of the antenna. The ground points may be shown by a serial number A in FIG. 2. FIG. 2 is a side view of the handheld device provided in the present invention.

Specifically, a sensor may be disposed on either side of each slit 4, and whether the user's finger connects the slit 4 is determined by detecting whether the user's finger touches the sensor. If the user's finger separately touches the sensors disposed on both sides of the slit 4, it is determined that the user's finger connects the slit 4. In addition, antenna efficiency may further be detected in real time. If the antenna efficiency dramatically deteriorates, it is determined that the user's finger connects a slit 4 corresponding to the switch 2 in a disconnected state.

Figure 3A:
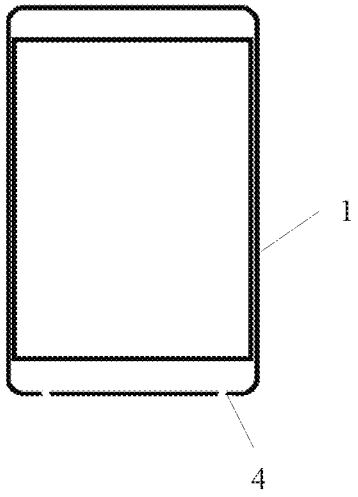
FIG. 3*a* is a schematic structural diagram of a handheld device with two slits symmetrically disposed at a bottom of a metal frame.
Figure 3B:
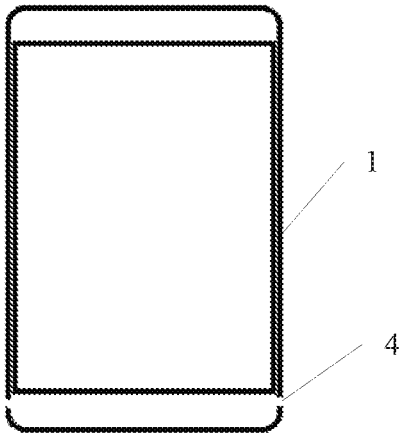
FIG. 3*b* is a schematic structural diagram of a handheld device with a slit disposed on either side of a metal frame.

As shown in FIG. 3*a* and FIG. 3*b*, the two slits 4 may be disposed at the bottom of the metal frame 1 or disposed on either side of the metal frame 1. In FIG. 3*a*, the two slits 4 are symmetrically disposed at the bottom of the metal frame 1. In FIG. 3*b*, the two slits are separately disposed on the two sides of the metal frame.

It should be noted that, in a narrow sense, the bottom may include only positions of the slits 4 in FIG. 3*a*; however, in a broad sense, the bottom may further include a top position of the handheld device in FIG. 3*a*, that is, alternatively, the two slits 4 may be disposed at a top position of the metal frame 1.

Further, when the two slits 4 are disposed at the bottom of the metal frame 1, a type of the switch 2 may be specifically a single-pole, single-throw switch (single pole single throw switch, SPST), a single-pole, double-throw switch (single pole double throw switch, SPDT), or a double-pole four-throw switch (DP4T).

In a first implementation scenario, the type of the switch 2 is a single-pole, single-throw switch. When the type of the switch 2 is a single-pole, single-throw switch, a schematic structural diagram of the handheld device may be specifically shown in FIG. 1. An input terminal and an output terminal of the switch 2 on the left are connected to the middle frame 12 and the left frame 11, respectively; and an input terminal and an output terminal of the switch 2 on the right are connected to the middle frame 12 and the right frame 13, respectively.

Figure 4:
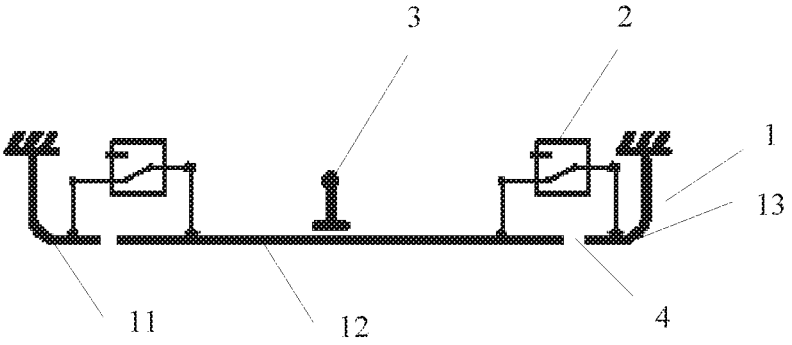
FIG. 4 is a schematic structural diagram of a connection between an antenna feedpoint and a middle frame in a coupling manner when a switch is a single-pole, single-throw switch.

On the basis of the embodiment shown in FIG. 1, there may be specifically two manners in which the antenna feedpoint 3 is electrically connected to the middle frame 12. In one manner, as shown in FIG. 1, the antenna feedpoint 3 is directly connected to the middle frame 12, to form an antenna design. In the other manner, as shown in FIG. 4, the antenna feedpoint 3 is connected to the middle frame 12 in a coupling manner, to form an antenna design, where FIG. 4 is a schematic structural diagram of a connection between the antenna feedpoint 3 and the middle frame 12 in a coupling manner when the switch is a single-pole, single-throw switch.

Figure 5:
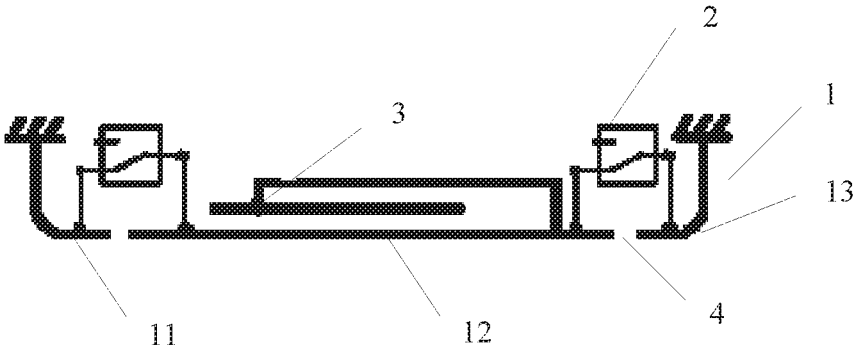
FIG. 5 is a schematic structural diagram of an antenna feedpoint disposed closer to one side when a switch is a single-pole, single-throw switch.

In addition, in a first case, the antenna feedpoint 3 may be located between the two switches 2, and distances from the antenna feedpoint 3 to the two switches 2 are equal, that is, the antenna feedpoint 3 is placed in the middle, to form a symmetrical design. In a second case, as shown in FIG. 5, the antenna feedpoint may be located between the two switches 2, and distances from the antenna feedpoint 3 to the two switches 2 are not equal, that is, the antenna feedpoint 3 is disposed closer to one side, to form an asymmetrical design, where FIG. 5 is a schematic structural diagram of the antenna feedpoint 3 disposed closer to one side when the switch is a single-pole, single-throw switch.

Figure 6:
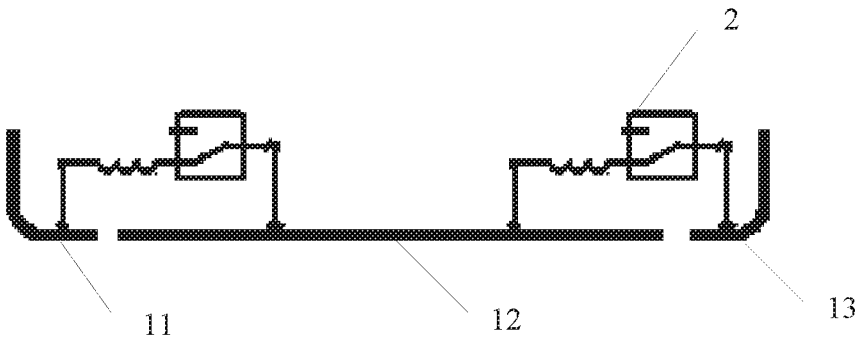
FIG. 6 is a schematic diagram of a connection between a metal frame and a single-pole, single-throw switch when an output terminal of the switch is serially connected to an inductor or a capacitor.

Further, in order to ensure that an antenna resonance frequency excited by a current on a path formed when a first switch 2 is disconnected and a second switch 2 is connected is basically consistent with an antenna resonance frequency excited by a current on a path formed when the first switch 2 is connected and the second switch 2 is disconnected, when the type of the switch 2 is a single-pole, single-throw switch, an output terminal of the switch 2 may be serially connected to an inductor or a capacitor. As shown in FIG. 6, the inductor or the capacitor serially connected to the output terminal of the switch 2 may finely adjust a required resonance frequency, where FIG. 6 is a schematic diagram of a connection between the metal frame 1 and the single-pole, single-throw switch when the output terminal of the switch 2 is serially connected to an inductor or a capacitor.

For example, when the antenna feedpoint 3 is disposed closer to one side, a built-in antenna assumes an asymmetrical design, and the antenna resonance frequency excited by the current on the path formed when the first switch 2 is disconnected and the second switch 2 is connected is inconsistent with the antenna resonance frequency excited by the current on the path formed when the first switch 2 is connected and the second switch 2 is disconnected. In this case, the inductor or capacitor serially connected to the output terminal of the switch 2 may finely adjust the foregoing frequencies, to make the two resonance frequencies consistent, which can improve antenna efficiency by about 10 DB in comparison with a "death grip" scenario.

However, when the antenna feedpoint 3 is disposed in the middle, a built-in antenna assumes a symmetrical design, and the antenna resonance frequency excited by the current on the path formed when the first switch 2 is disconnected and the second switch 2 is connected is basically consistent with the antenna resonance frequency excited by the current on the path when the first switch 2 is connected and the second switch 2 is disconnected, which can improve antenna efficiency by over 13 DB in comparison with a "death grip" scenario.

Figure 7:
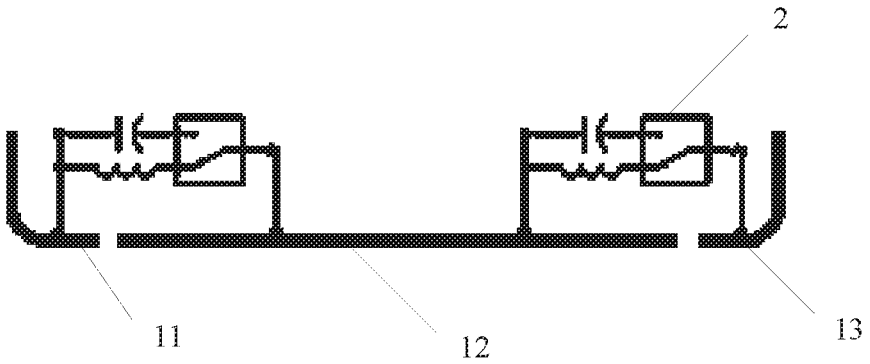
FIG. 7 is a schematic diagram of a connection between a metal frame and a switch when a type of the switch is a single-pole, double-throw switch.

In a second implementation scenario, the type of the switch 2 is a single-pole, double-throw switch. FIG. 7 shows a schematic diagram of a connection between the metal frame 1 and the switch 2 when the type of the switch 2 is a single-pole, double-throw switch. After one output terminal of a single-pole, double-throw switch on the left is serially connected to an inductor or a capacitor, and the other output terminal of the single-pole, double-throw switch on the left is serially connected to an inductor or a capacitor, the two output terminals may be connected to the left frame 11; and after one output terminal of a single-pole, double-throw switch on the right is serially connected to an inductor or a capacitor, and the other output terminal of the single-pole, double-throw switch on the right is serially connected to an inductor or a capacitor, the two output terminals may be connected to the middle frame 12.

Further, each output terminal of the single-pole, double-throw switch may be serially connected to an inductor or a capacitor, and a frequency band handover is implemented by switching the switch 2.

On the basis of the type of the switch shown in FIG. 7, there may be specifically two manners in which the antenna feedpoint 3 is electrically connected to the middle frame 12. In one manner, the antenna feedpoint 3 is directly connected to the middle frame 12, to form an antenna design. In the other manner, the antenna feedpoint 3 is connected to the middle frame 12 in a coupling manner, to form an antenna design. In addition, the antenna feedpoint 3 may be located between the two switches 2, either disposed in the middle to form a symmetrical design, or disposed closer to one side to form an asymmetrical design.

Figure 8:
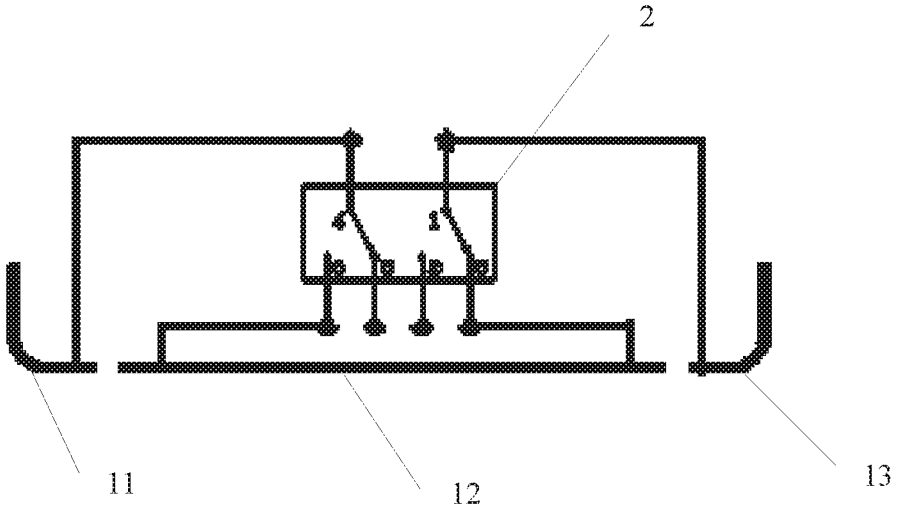
FIG. 8 is a schematic diagram of a connection between a metal frame and a switch when a type of the switch is a double-pole, four-throw switch.

In a third implementation scenario, the type of the switch 2 is a double-pole, four-throw switch. FIG. 8 shows a schematic diagram of a connection between the metal frame 1 and the switch 2 when the type of the switch 2 is a double-pole, four-throw switch. One input terminal of the double-pole four-throw switch is connected to the left frame 11, and the other input terminal of the double-pole four-throw switch is connected to the right frame 13. Among four output terminals of the double-pole four-throw switch, two output terminals are connected to the middle frame 12, and the other two output terminals are disconnected. The double-pole four-throw switch has two connection states: In a first connection state, a left slit 4 is connected, and a right slit 4 is disconnected; or in a second connection state, a left slit 4 is disconnected, and a right slit 4 is connected.

On the basis of the type of the switch shown in FIG. 8, there may be specifically two manners in which the antenna feedpoint 3 is electrically connected to the middle frame 12. In one manner, the antenna feedpoint 3 is directly connected to the middle frame 12, to form an antenna design. In the other manner, the antenna feedpoint 3 is connected to the middle frame 12 in a coupling manner, to form an antenna design. In addition, the antenna feedpoint 3 may be located between the two switches 2, either disposed in the middle to form a symmetrical design, or disposed closer to one side to form an asymmetrical design.

Further, in order to ensure that an antenna resonance frequency excited by a current path in the first connection state is basically consistent with an antenna resonance frequency excited by a current path in the second connection state, the output terminals of the double-pole four-throw switch may also be serially connected to an inductor or a capacitor, to finely adjust an antenna resonance frequency.

Figure 9:
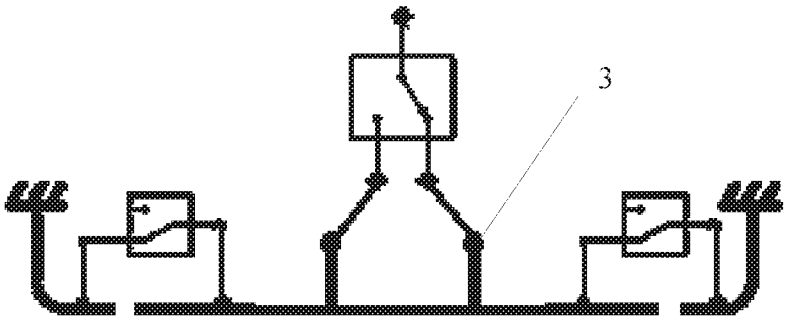
FIG. 9 is a schematic structural diagram of a handheld device in which two antenna feedpoints are disposed when a switch type is a single-pole, single-throw switch.

On the basis of the embodiments corresponding to the foregoing three switch types, alternatively, as shown in FIG. 9, there may be two antenna feedpoints 3, and the two antenna feedpoints are symmetrically disposed and are switched by using a switch 2, where FIG. 9 is a schematic structural diagram of a handheld device in which two antenna feedpoints 3 are disposed when a type of the switch 2 is a single-pole, single-throw switch.

Figure 10:
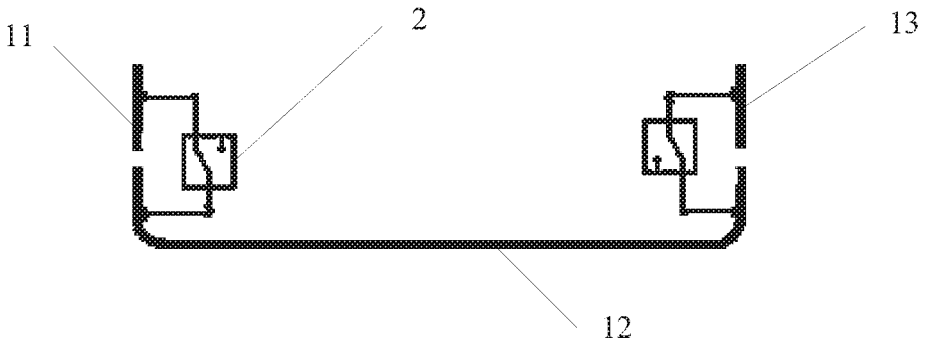
FIG. 10 is a schematic diagram of a connection between a single-pole, single-throw switch and a metal frame.

Further, when the two slits 4 are separately disposed on two sides of the metal frame 1, for specific details about the type of the switch 2, and manners in which the metal frame 1 is connected to various types of switches 2, refer to the descriptions and related schematic diagrams of the case in which the two slits 4 are disposed at the bottom of the metal frame 1. In the case in which the two slits 4 are separately disposed on the two sides of the metal frame 1, a schematic diagram of a connection between a single-pole, single-throw switch and the metal frame 1 may be shown in FIG. 10.

Figure 11:
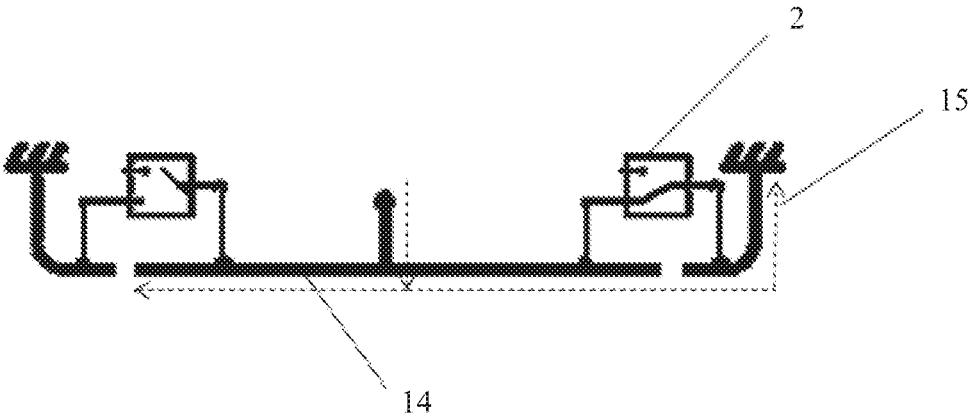
FIG. 11 is a schematic diagram of a current direction of the handheld device provided in FIG. 1.

In this embodiment, referring to FIG. 11, when a left slit is connected and a right slit is disconnected, a feeding current 15 of an antenna feedpoint can reach a ground point of a left frame through the left slit, and a feeding current 14 of the antenna feedpoint terminates when arriving at the right slit. In this state, the left slit is connected; therefore, if a user's finger connects the left slit, antenna efficiency is not affected, which avoids a "death grip". Similarly, when the left slit is disconnected and the right slit is connected, a feeding current of the antenna feedpoint can reach a ground point of the right frame through the right slit, and a feeding current of the antenna feedpoint terminates when arriving at the left slit. In this state, the right slit is connected; therefore, if the user's finger connects the right slit, antenna efficiency is not affected, which avoids a "death grip". The two switches are configured to perform state switching when the user's finger connects a slit corresponding to a switch in a disconnected state, which can enable a handheld device to have a slit in a disconnected state and a slit in a connected state in real time, thereby improving communication quality of a handheld communications device.

In this embodiment, a handheld device is provided, including a metal frame, two switches, and an antenna feedpoint, where two slits are disposed at a bottom of the metal frame, or a slit is disposed on either side of the metal frame; the slits divide the metal frame into a left frame 11, a middle frame 12, and a right frame 13; two sides of each slit are bridged by one of the switches, where one of the switches is in a connected state, the other of the switches is in a disconnected state, and the two switches perform state switching when a user's finger connects a slit corresponding to the switch in a disconnected state; and the antenna feedpoint is connected to the middle frame 12, to form an antenna. When the user's finger connects the slit corresponding to the switch in a disconnected state, the two switches perform state switching to avoid a "death grip", so that the built-in antenna has one slit in a disconnected state in real time, thereby improving communication quality of the handheld communications device.

In the several embodiments provided in this application, it should be understood that the disclosed system, apparatus, and method may be implemented in other manners. For example, the described apparatus embodiment is merely exemplary. For example, the module or unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The foregoing embodiments are merely used to describe the technical solutions of the present application. The foregoing embodiments are merely intended to help understand the method and core idea of the present invention, and shall not be construed as a limitation on the present invention. Any variation or replacement readily figured out by a person skilled in the art within the technical scope disclosed in the present invention shall fall within the protection scope of the present invention.

What is claimed is:

1. A handheld device, comprising:

a metal frame having a first slit and a second slit that divide the metal frame into a left frame portion, a middle frame portion, and a right frame portion, wherein the left frame portion and the right frame portion are electrically connected to ground;

a first switch bridging two sides of the first slit, wherein the first switch is in a connected state;

a second switch bridging two sides of the second slit, wherein the second switch is in a disconnected state, and wherein the first switch and the second switch are configured to switch states in response to the second slit receiving a touch input; and an antenna feedpoint electrically connected to the middle frame portion forming an antenna with the left frame portion and the right frame portion.

2. The handheld device according to claim 1, wherein both the first switch and the second switch comprise a single-pole, single-throw switch.

3. The handheld device according to claim 2, wherein at least one of the first switch or the second switch comprises an output terminal that is serially connected to an inductor or a capacitor to finely adjust a resonance frequency at the antenna feedpoint.

4. The handheld device according to claim 1, wherein at least one of the first switch or the second switch comprises a single-pole, double-throw switch.

5. The handheld device according to claim 4, wherein one or more output terminals of at least one of the first switch or the second switch is serially connected to the metal frame using an inductor or a capacitor, and wherein the one or more output terminals are configured to perform a frequency band handover when the first switch and the second switch switch states.

6. The handheld device according to claim 4, wherein the first switch and the second switch are equidistant to the antenna feedpoint.

7. The handheld device according to claim 4 wherein the first switch and the second switch are not equidistant to the antenna feedpoint.

8. The handheld device according to claim 4, wherein the antenna feedpoint is directly connected to the middle frame portion using an antenna trace.

9. The handheld device according to claim 4, wherein the antenna feedpoint is connected to the middle frame portion in a coupling manner using an antenna trace.

10. The handheld device according to claim 4, wherein the antenna feedpoint is an only antenna feedpoint of the handheld device.

11. The handheld device according to claim 4, wherein:

the antenna feedpoint is a first antenna feedpoint; and the handheld device further comprises a second antenna feedpoint, wherein the first antenna feedpoint and the second antenna feedpoint are switched using a switch.

12. The handheld device according to claim 4, further comprising a metal back cover.

13. The handheld device according to claim 12, wherein the metal back cover is integrated with the metal frame.

14. The handheld device according to claim 4, wherein each of the first slit and the second slit is disposed at a bottom of the metal frame.

15. The handheld device according to claim 4, wherein at least one of the first slit or the second slit is disposed on a side of the metal frame.

* * * * *